US009129727B2

(12) United States Patent
Caveney et al.

(10) Patent No.: US 9,129,727 B2
(45) Date of Patent: Sep. 8, 2015

(54) COMMUNICATION CABLE WITH EMBOSSED TAPE HAVING ENCAPSULATED GAS

(75) Inventors: Jack E. Caveney, North Palm Beach, FL (US); Ronald A. Nordin, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 774 days.

(21) Appl. No.: 12/771,808

(22) Filed: Apr. 30, 2010

(65) Prior Publication Data

US 2010/0276181 A1 Nov. 4, 2010

Related U.S. Application Data

(60) Provisional application No. 61/175,263, filed on May 4, 2009.

(51) Int. Cl.
*H01B 7/00* (2006.01)
*H01B 11/10* (2006.01)

(52) U.S. Cl.
CPC ..... *H01B 11/1008* (2013.01)

(58) Field of Classification Search
USPC ..... 174/110 R, 113 R, 36, 25 G
See application file for complete search history.

(56) References Cited

U.S. PATENT DOCUMENTS 2,591,794 A * 4/1952 Ebel ..... 174/25 G
3,701,840 A 10/1972 Willmore
6,534,715 B1 3/2003 Maunder et al.
6,921,864 B2 7/2005 Grogl et al.
7,220,332 B2 5/2007 Curro et al.
7,271,344 B1 9/2007 Stutzman et al.
2006/0048961 A1 * 3/2006 Pfeiler et al. ..... 174/36
2007/0037419 A1 * 2/2007 Sparrowhawk ..... 439/98
2007/0098940 A1 * 5/2007 Heffner ..... 428/36.9
2007/0193769 A1 * 8/2007 Clark et al. ..... 174/113 R
2007/0209824 A1 * 9/2007 Stutzman et al. ..... 174/113 R

FOREIGN PATENT DOCUMENTS

JP 53-33382 * 3/1978

* cited by examiner

*Primary Examiner* — Chau N Nguyen

(74) *Attorney, Agent, or Firm* — Christopher S. Clancy; Yuri Astvatsaturov

(57) ABSTRACT

A layered tape having pockets therein is used as part of a communication cable to improve alien crosstalk attenuation. In one embodiment, a single layered tape has an embossed layer bonded to a matrix tape layer having non-continuous conductive traces, with the resulting layered tape reducing alien crosstalk between cables. Pockets resulting from the embossing are filled with a gas such as dry air to decrease the dielectric constant through the effective thickness of the tape. A layered tape may alternatively be provided as a separate tape from a matrix tape, such that coupling between conductive pairs of the cable and the matrix tape is reduced. Decreasing the dielectric constant of materials between adjacent cables also decreases alien crosstalk coupling between the cables.

19 Claims, 3 Drawing Sheets

COMMUNICATION CABLE WITH EMBOSSED TAPE HAVING ENCAPSULATED GAS

CROSS-REFERENCE TO RELATED APPLICATION

This application claims priority to U.S. Provisional Application No. 61/175,263, filed May 4, 2009, the subject matter of which is hereby incorporated by reference in its entirety.

FIELD OF THE INVENTION

The present invention relates to communication cables, and more particularly to methods and apparatus to enhance the attenuation of alien crosstalk associated with such cables.

BACKGROUND OF THE INVENTION

As networks become more complex and have a need for higher bandwidth cabling, attenuation of cable-to-cable crosstalk (or "alien crosstalk") becomes increasingly important to provide a robust and reliable communication system. Alien crosstalk is primarily coupled electromagnetic noise that can occur in a disturbed cable arising from signal-carrying cables that run near the disturbed cable.

It is desirable to decrease the amount of this coupling. This coupling can be decreased by decreasing the dielectric constant of the material between neighboring cables and also by providing barriers to electromagnetic interference between adjacent cables.

SUMMARY OF THE INVENTION

The present invention relates to the use of an embossed tape having air pockets provided therein as a method of decreasing alien crosstalk between electrical communication cables. In one embodiment, the present invention comprises a double-layered tape having gas pockets that is wrapped around the wire pairs of a high performance 10 Gb/s (gigabit/second) unshielded twisted pair (UTP) cable. This tape is preferably disposed between the twisted conductive pairs of a communication cable and a "matrix tape" having non-continuous conductive traces.

The matrix tape is a tape having separated conductive portions provided thereon. Examples of matrix tapes that can be used with the present invention include the tapes disclosed in any of the following applications: U.S. patent application Ser. No. 12/399,331, filed Mar. 6, 2009 and entitled "Communication Cable with Improved Crosstalk Attenuation"; U.S. Provisional Patent Application Ser. No. 61/054,330, filed May 19, 2008 and entitled "Communication Cable with Improved Crosstalk Attenuation"; and U.S. Provisional Patent Application Ser. No. 61/112,794, filed Nov. 10, 2008 and entitled "Communication Cable with Improved Crosstalk Attenuation," the subject matters of which are incorporated herein in their entireties.

It is preferred that cables according to the present invention meet TIA/EIA Cat 6a cable performance requirements.

DETAILED DESCRIPTION OF THE EMBODIMENTS

Figure 1:
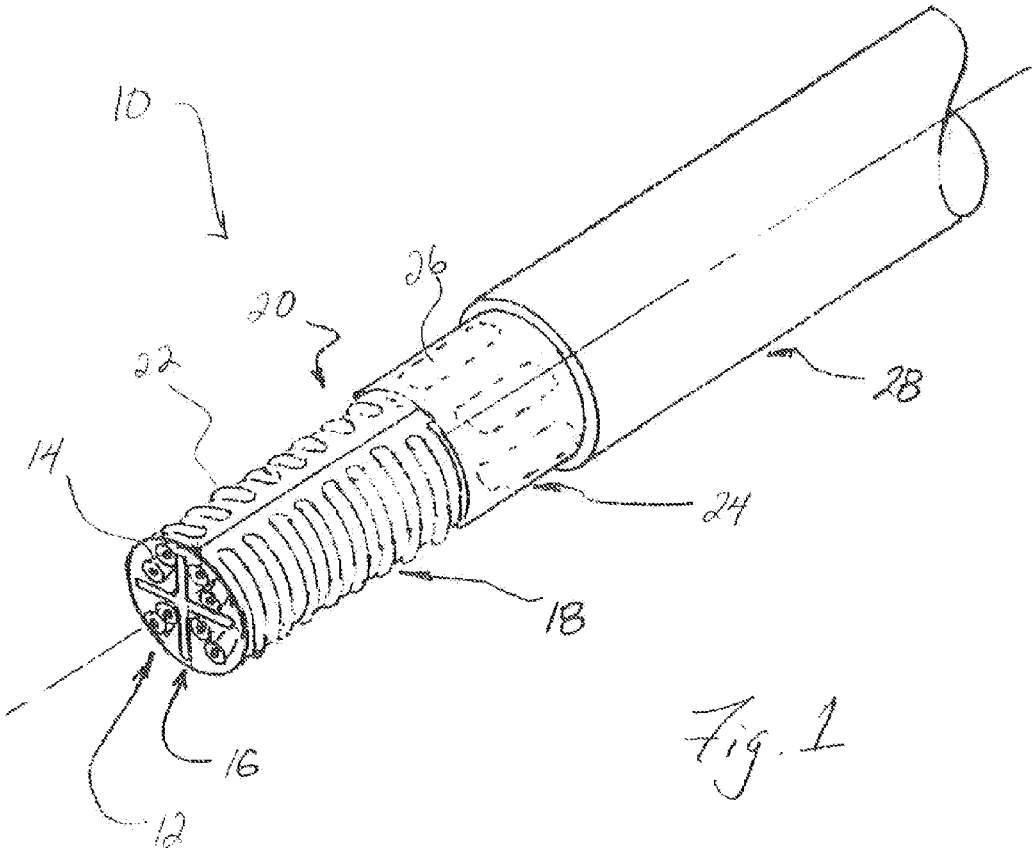
FIG. 1 is a perspective view of a communication cable according to the present invention showing layers of the communication cable.

Referring now to the drawings, and more particularly to FIG. 1, there is shown a communication cable 10, having a cable core 12 comprising four twisted pairs of conductors 14 and a pair separator 16. As in a typical twisted-pair cable, the core 12 is itself twisted within the cable.

The core 12 is surrounded by a layered tape 18 having a pattern 20 of gas-filled pockets 22 provided thereon. It is preferred for the gas pockets 22 to be filled with dry air, as described in greater detail below, thereby lowering the dielectric constant of the layered tape 18 for a given effective thickness of the layered tape 18, though other gases may be used.

The layered tape 18 is disposed between the cable core 12 and a matrix tape 24 comprising a plurality of conductive patches 26. Preferably, the matrix tape 24 is of the type shown and described in any of the following applications: U.S. patent application Ser. No. 12/399,331, filed Mar. 6, 2009 and entitled "Communication Cable with Improved Crosstalk Attenuation"; U.S. Provisional Patent Application Ser. No. 61/054,330, filed May 19, 2008 and entitled "Communication Cable with Improved Crosstalk Attenuation"; and U.S. Provisional Patent Application Ser. No. 61/112,794, filed Nov. 10, 2008 and entitled "Communication Cable with Improved Crosstalk Attenuation." A jacket 28 surrounds the matrix tape 24.

Figure 4:
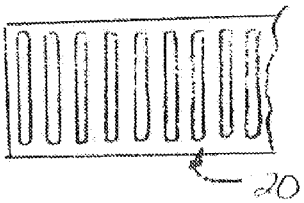
FIG. 4 is a plan view of a layered tape according to another embodiment of the present invention.

In this configuration, the layered tape 18 serves as a barrier between the matrix tape 24 and the twisted pairs 14 of the cable core 12. The pockets 22 serve to decrease the overall dielectric constant of the space between the twisted pairs 18 and the matrix tape 24. This decreases the electrical coupling between the twisted pairs 18 and the matrix tape 24, and in turn decreases the alien crosstalk between the cable 10 and an adjacent cable. The pattern 20 of pockets 22 shown in FIG. 1 is a radial pattern, shown in a plan view in FIG. 4.

Figure 2:
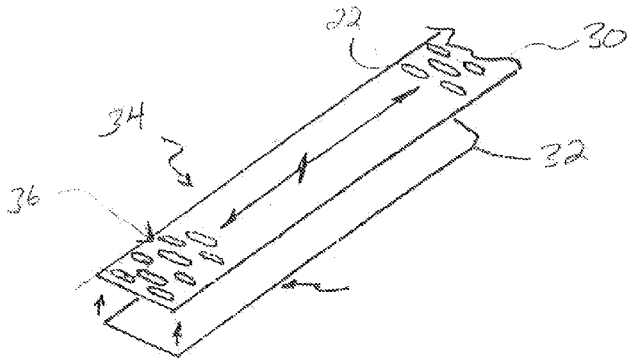
FIG. 2 is a perspective view showing two layers of a layered tape according to one embodiment of the present invention.

Other patterns of pockets 22 may be used. For example, FIG. 2 shows first and second tape layers 30 and 32 of a layered tape 34 having a staggered radial pattern 36 of pockets 22. As shown in FIG. 2, layered tapes according to the present invention are preferably formed by embossing pocket shapes in a first tape layer 30 and affixing the first tape layer 30 to the second tape layer 32 in an environment of dry air. The two tape layers 30 and 32 are preferably joined to one another by heat sealing or by bonding, for example using a UV-cured adhesive.

Figure 3:
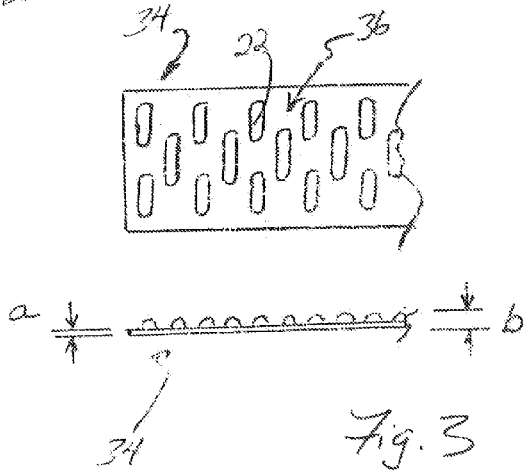
FIG. 3 shows a plan view and a side view of a layered tape according to one embodiment of the present invention.

FIG. 3 shows a plan view of the layered tape 34 having a staggered radial pattern 36, along with a side view of the layered tape 34. As shown, the layered tape 34 has a base thickness a which is the combined thicknesses of the first and second layers 30 and 32 without embossing, and an effective thickness b which is the thickness of the layered tape 34 at is thickest points where the pockets 22 are located. According to one embodiment, the base thickness a is approximately 0.002" and the effective thickness b is in the range from approximately 0.11" to approximately 0.14".

Figure 5:
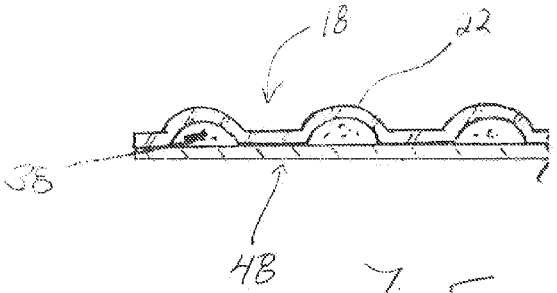
FIG. 5 is a cutaway side view of a layered tape according to one embodiment of the present invention.

FIG. 5 is a cutaway side view of a layered tape 18 showing a representation of dry air 38 within the pockets 22, along with seal regions 48 between the pockets 22.

Figure 6:
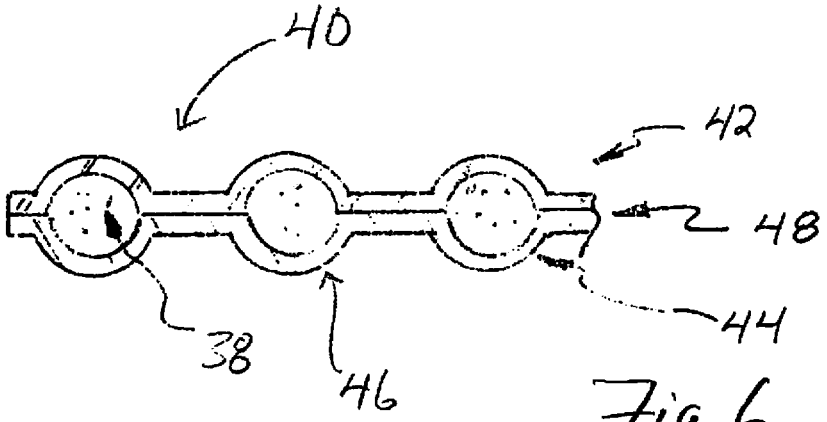
FIG. 6 is a cutaway side view of a layered tape according to another embodiment of the present invention.

FIG. 6 is a cutaway side view of an alternative embodiment of a layered tape 40 having first and second embossed layers 42 and 44 forming pockets 46 that are filled with a gas such as dry air 38. The first and second embossed layers 42 and 44 are joined together at seal regions 48.

Figure 7:
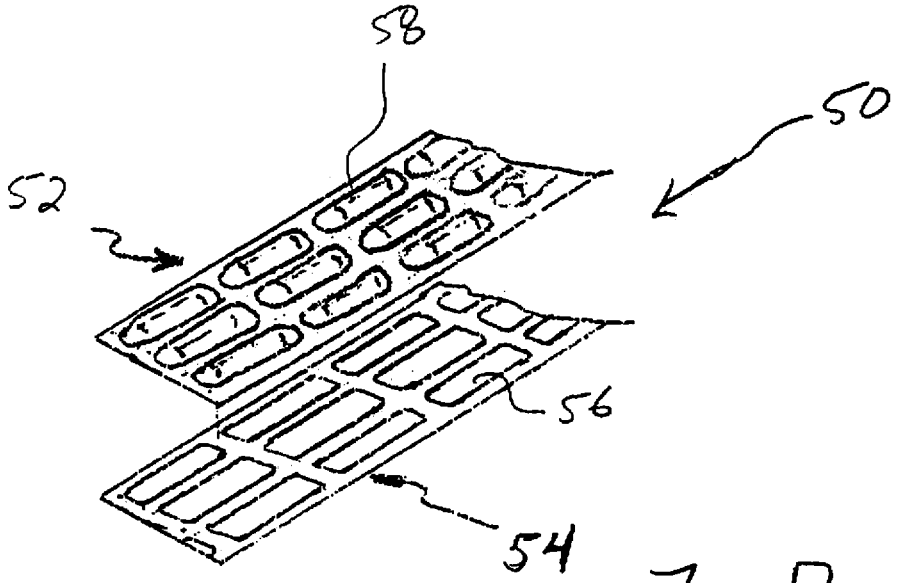
FIG. 7 is a perspective view of two layers of a layered tape according to another embodiment of the present invention.

FIG. 7 is an exploded view of another embodiment of layered tape 50 in which an inner embossed layer 52 is bonded to an outer matrix tape layer 54 comprising conductive patches 56. This forms a layered tape 50 that combines the features of the matrix tape 24 (shown in FIG. 1) with a decreased overall dielectric between the cable core 12 and the matrix tape layer 54 when the embossed layer 52 is situated on the inner side of the cable, around the cable core. The bonding of the inner embossed layer 52 to the outer matrix tape layer 54 creates a single layered tape that can be incorporated into a cable, accomplishing the goal of reducing alien crosstalk when cables are placed adjacent one another.

Layered tapes according to the present invention may feature radial or longitudinal embossing patterns, and the tape may be comprised of two embossed layers, a single embossed layer and an unembossed layer, or an embossed layer and a matrix tape layer having conductive patches. Further, layered tapes according to the present invention may be wrapped around a cable core 12 in a longitudinal or "cigarette" style as shown in FIG. 1 or in a spiral wrap style.

The invention claimed is:

1. A communication cable comprising:

a jacket;

a cable core comprising a plurality of twisted pairs of conductors; and a layered tape surrounding said cable core, and disposed between said cable core and said jacket, said layered tape comprising a plurality of gas-filled pockets, each of said plurality of gas-filled pockets being non-continuous, wherein no electrically shielding layer is disposed between said gas-filled pockets and said cable core, and wherein said gas-filled pockets are provided in a staggered radial pattern.

2. The communication cable of claim 1 further comprising a pair separator separating said twisted pairs of conductors in said cable core.

3. The communication cable of claim 1 wherein said gas-filled pockets are filled with dry air.

4. The communication cable of claim 1 further comprising a matrix tape surrounding said layered tape, said matrix tape comprising a plurality of non-continuous conductive traces.

5. The communication cable of claim 1 wherein said layered tape comprises two tape layers joined to one another.

6. The communication cable of claim 1 wherein said layered tape has a base thickness of approximately 0.002" and an effective thickness in the range of from approximately 0.11" to approximately 0.14".

7. The communication cable of claim 1 wherein said layered tape comprises an embossed layer bonded to a matrix tape layer, said matrix tape layer comprising a plurality of non-continuous conductive traces.

8. The communication cable of claim 1 wherein said layered tape is one of longitudinally or spirally wrapped around said cable core.

9. The communication cable of claim 1 wherein each said plurality of gas-filled is of substantially same dimensions.

10. The communication cable of claim 1 wherein a central axis of said communication cable is coaxial with a central axis of said cable core.

11. A communication cable comprising:

a cable core comprising a plurality of twisted pairs of conductors and a pair separator separating said twisted pairs of conductors;

a jacket;

a layered tape surrounding said cable core, said layered tape comprising a plurality of gas-filled pockets; each of said plurality of gas-filled pockets being non-continuous; and a matrix tape surrounding said layered tape, said matrix tape comprising a plurality of non-continuous conductive traces; wherein said layered tape and said matrix tape are disposed between said cable core and said jacket, and wherein no electrically shielding layer is diposed between said gas-filled pockets and said cable core, wherein each of said plurality of non-continuous conductive traces is positioned substantially orthogonal to one of said plurality of gas-filled pockets.

12. The communication cable of claim 11 wherein said layered tape has a base thickness of approximately 0.002" and an effective thickness in the range of from approximately 0.11" to approximately 0.14".

13. The communication cable of claim 11 wherein said layered tape is one of longitudinally or spirally wrapped around said cable core.

14. A communication cable comprising:

a jacket;

a cable core comprising a plurality of twisted pairs of conductors; and a layered tape surrounding said cable core and disposed between said cable core and said jacket, said layered tape comprising a plurality of gas-filled pockets, each of said plurality of gas-filled pockets being non-continuous, said layered tape comprising a first embossed layer and a second embossed layer joined to one another to form said plurality of gas-filled pockets.

15. The communication cable of claim 14 wherein said layered tape is one of longitudinally or spirally wrapped around said cable core.

16. The communication cable of claim 14 wherein each said plurality of gas-filled is of substantially same dimensions.

17. The communication cable of claim 14 further comprising a matrix tape surrounding said layered tape, said matrix tape comprising a plurality on non-continuous conductive traces, wherein said layered tape and said matrix tape are disposed between said cable core and said jacket.

18. The communication cable of claim 17 wherein each of said plurality of non-continuous conductive traces is positioned substantially orthogonal to one of said plurality of gas-filled pockets.

19. A communication cable comprising:

a jacket;

a cable core comprising a plurality of twisted pairs of conductors; and a layered tape surrounding said cable core and disposed between said cable core and said jacket, said layered tape comprising a plurality of gas-filled pockets, each of said plurality of gas-filled pockets being non-continuous, wherein no electrically shielding layer is disposed between said gas-filled pockets and said cable core, and wherein said layered tape comprises and embossed layer bonded to a matrix tape layer, said matrix tape layer comprising a plurality of non-continuous conductive traces.

* * * * *